United States Patent [19]

Goldfarb et al.

[11] Patent Number: 4,778,430

[45] Date of Patent: Oct. 18, 1988

[54] WATER SLIDE TOY

[75] Inventors: Adolph E. Goldfarb, 1432 South Wind Cir., Westlake Village, Calif. 91361; Marvin N. Rothenberg, Los Angeles, Calif.

[73] Assignee: Adolph E. Goldfarb, Northridge, Calif.

[21] Appl. No.: 943,325

[22] Filed: Dec. 31, 1986

[51] Int. Cl.[4] ..... A63H 29/14

[52] U.S. Cl. ..... 446/167; 446/171

[58] Field of Search ..... 446/167, 166, 169, 171, 446/172, 168, 153, 156, 159, 176, 267; 104/73; 273/86 C; 272/32

[56] References Cited

U.S. PATENT DOCUMENTS 419,860 1/1890 Libbey ..... 446/153 X 891,388 6/1908 Visser ..... 446/153 X 1,260,664 3/1918 Gregory ..... 446/171

*Primary Examiner*—Mickey Yu

*Attorney, Agent, or Firm*—Ashen Golant Martin & Seldon

[57] ABSTRACT

A water slide toy including: a downwardly inclined slide having an upper end and a lower end; a carrier for moving separate discreet objects such as human or animal figures from the lower end of the slide back up to the upper end of the slide so that the objects can slide downwardly from that slide upper end; a reservoir for holding a quantity of water; a pump for delivering the water to the upper end of the slide to facilitate the downward sliding movement of the objects; and a passageway between the slide and the reservoir for returning water to the reservoir.

18 Claims, 2 Drawing Sheets

FIG 2
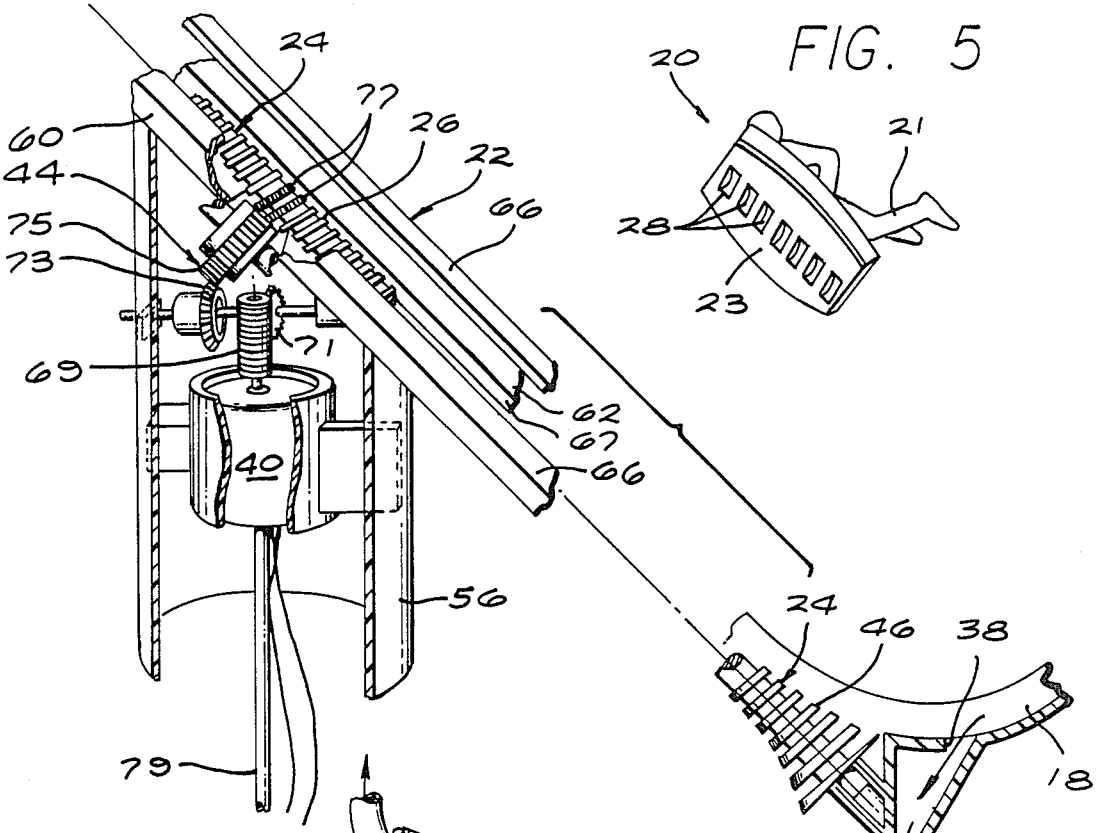
FIG. 5
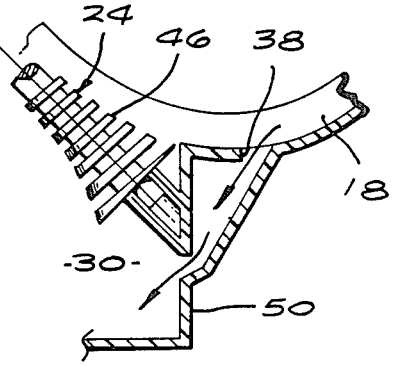
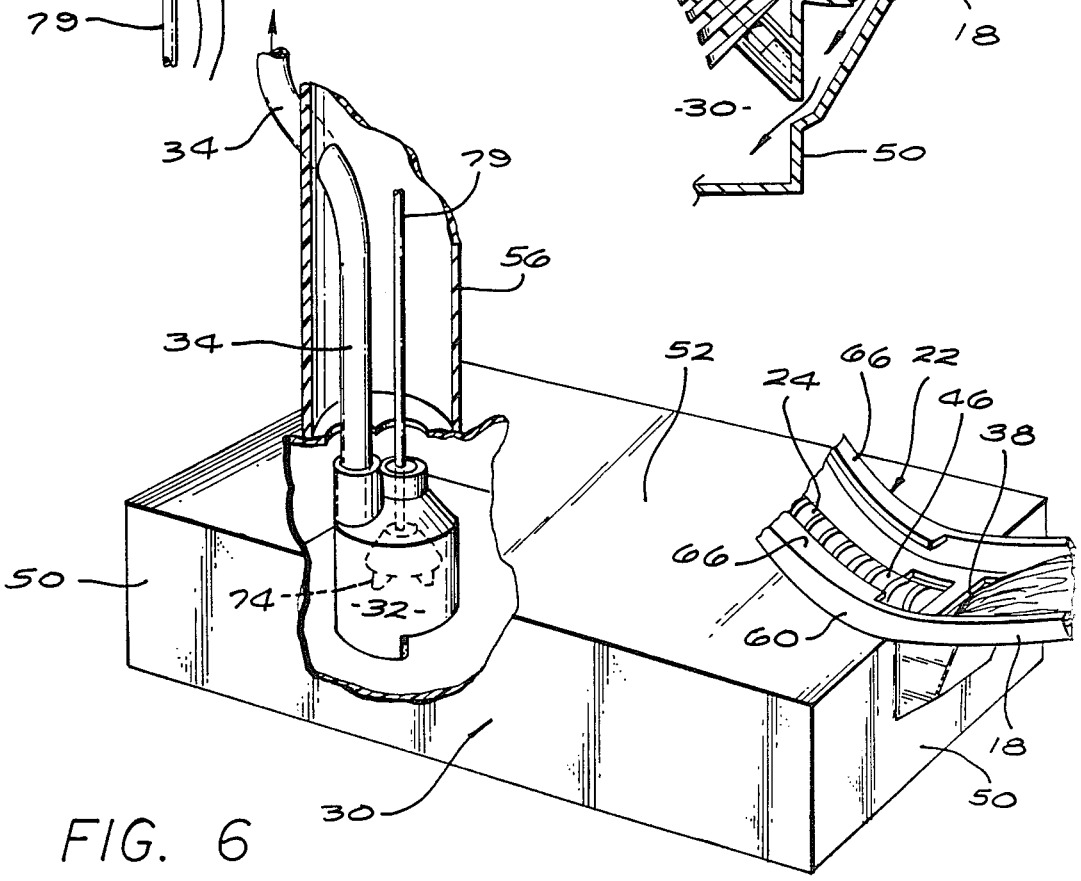
FIG. 6

WATER SLIDE TOY

BACKGROUND OF INVENTION

Life size water slides have become very popular. Children love action toys i.e. toys that "do something". A toy in this category is a slide toy where objects are moved to the top of a slide and then allowed to slide down the slide by virtue of gravity. Such toys have substantial play value, especially for younger children. Such toys are especially enjoyable when the objects slide down "very fast". The speed of descent is to a great extent dependent on the downward angle of incline: the greater the angle, the faster the object tends to move downwardly along the incline. To increase the angle of the incline however the toy has to be made taller and taller.

The present invention contemplates providing water at the top of the slide to facilitate the downward movement of the objects. This permits a relatively shallow angle of downward incline, accompanied by a relatively rapid rate of descent. In addition, the provision of water moving down the slide adds another dimension or aspect to the play value of the toy. Children like playing with water. Thus, the water slide of the present invention provides an enhanced slide toy having added dimensions of play value for the child user.

SUMMARY OF DISCLOSURE

A presently preferred form of the invention is illustrated in the drawings as water slide toy 10. In broad terms, the toy 10 includes a frame 12 which supports a slide section 14 having an upper end 16 and a lower end 18. The illustrated slide section 14 has an upper spiral portion and a lower elongated curved portion. A plurality of discrete objects 20 are provided in the form of humanoid FIG. 21 mounted upon boards or boats 23. The toy includes conveyor or carrier means 22 for moving the objects 20 upwardly along an incline from the lower end of the slide section back up to the upper end of the slide section. From there the objects are released for sliding movement down the slide section. The illustrated conveyor means 22 comprises generally a rotating screw 24 having a spiral rib 26 that engages a series of angled grooves 28 in the underside of the supporting boards 23 of the objects. As the screw 24 rotates, the objects are moved upwardly along the incline of the carrier.

The toy further includes water holding means in the form of a reservoir 30 and water delivering means in the form of a pump 32 that forces water from the reservoir up through a conduit or pipe 34 to an outlet 36 at the upper end 16 of the slide section. From there water is discharged onto the slide section to facilitate the downard sliding movement of the objects. Water return means in the form of a passageway 38 from the lower end 18 of the slide section back to the reservoir 30 is also provided so that the water coming down the slide section can return to the reservoir.

Power or drive means may be provided for the toy as in the form of an electric motor 40 powered by batteries 42; the motor 40 may drive the water pump 32 and also, through a gear train 44, the spiral screw 24 of the conveyor means 22. Alternatively the water pump 32 and the conveyor screw 24 might be manually powered as by the child rotating a hand crank (not shown).

In operation, the conveyor screw 24 is rotated to move the objects 20 upwardly along the conveyor 22 to the upper end 16 of the slide section, while water is also pumped through conduit 34 to that upper end of the slide section. Thus, the descent of the object along the slide section is accompanied by a flow of water to facilitate that downward sliding action: more particularly the speed of descent is increased, there is the appearance of the object being swept along in a tide of water, and there is also the visual effect of the object being bounced or tossed about by the action of the water, especially at points of turbulence such as where the water goes around a curve or a possibly narrowed portion of the slide. The water reaching the lower end 18 of the slide section returns to the reservoir 30 through the water return passageway 38. The objects go from the lower end of the slide section to the lower end of the conveyor means 22. This change of direction from a generally downward movement to an upward movement is facilitated by the enlarged lower end 46 of the conveyor screw 24. The upper end 16 of the slide section is provided with upstanding spaced apart ribs 48 that ensure that the objects will not block the flow of water from the outlet 36 of the water delivering means at the upper end of the slide.

DETAILED DRAWINGS

FIG. 2 is an enlarged fragmentary view (with portions broken away) taken generally along line 2—2 of FIG. 1, showing the drive mechanism for the toy;

Figures 1, 3, 4, 4A:
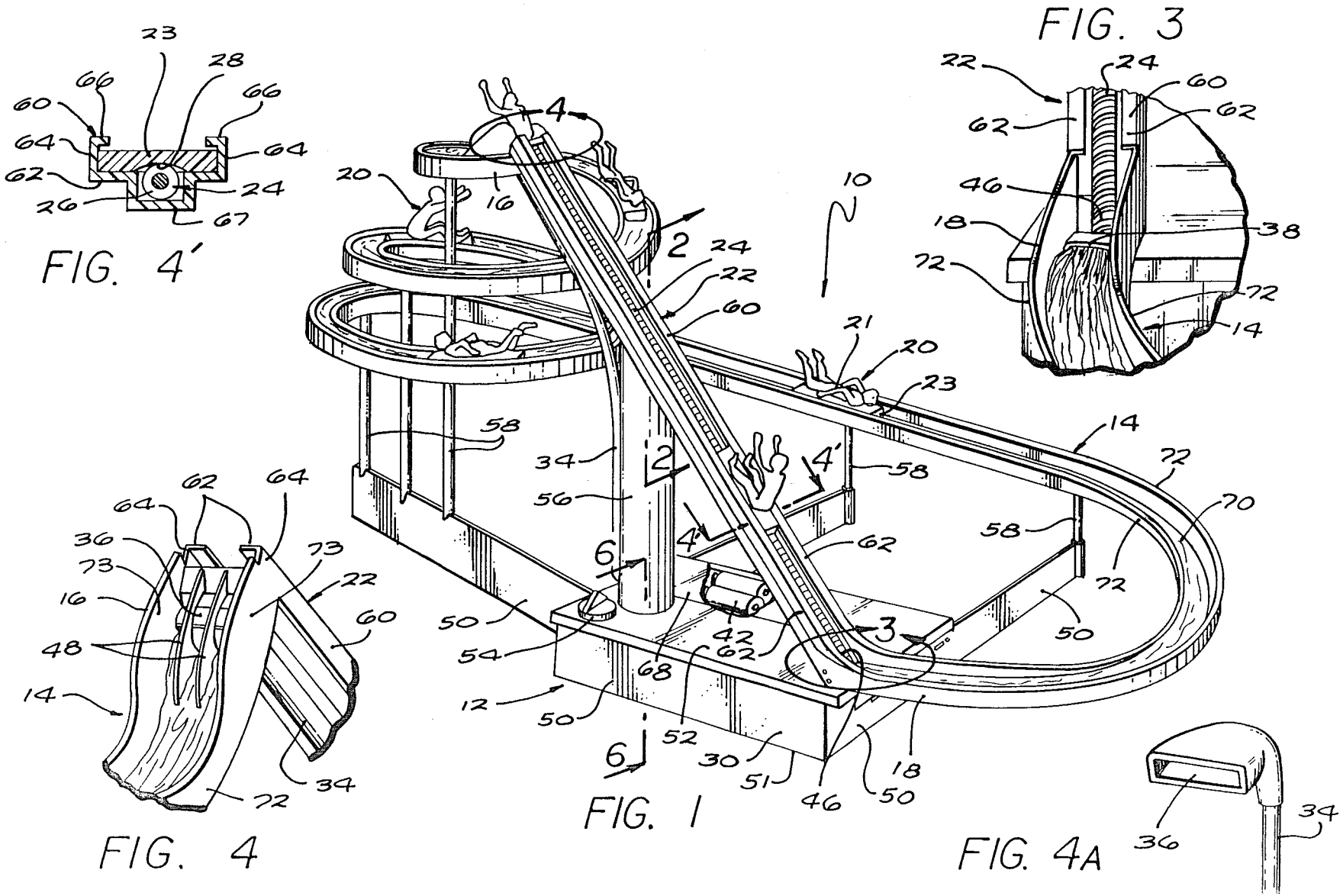
FIG. 1 is a perspective view of a presently preferred embodiment of the present invention in the form of a water slide toy.
FIG. 3 is an enlarged perspective view of the area identified by circular line 3—3 of FIG. 1, showing the enlarged lower end of the conveyor screw.
FIG. 4 is an enlarged perspective view of the area identified by circular line 4—4 of FIG. 1, showing the upper ends of the slide section and of the conveyor means.
FIG. 4A is an enlarged perspective view of the water conduit upper end and the outlet.

FIG. 4' is an enlarged sectional view taken generally along line 4'—4' of FIG. 1;

FIG. 5 is an enlarged bottom perspective view of one of the objects of the illustrated toy; and FIG. 6 is an enlarged fragmentary view (with portions broken away) taken generally along line 6—6 of FIG. 1, showing the reservoir, water pump, and water return.

DETAILED DESCRIPTION

Now the presently preferred embodiment of the water slide toy of the present invention as illustrated in the drawings will be described in further detail. The water slide toy 10 comprises a frame 12 that has a base made up of a plurality of upright wall sections or portions 50. Four of these wall sections are arranged to surround a rectangular area which is also provided with a floor or bottom wall section 51 to define the water reservoir or container 30. A cover 52 is also provided to enclose the reservoir. The cover 52 is provided with a removable filler cap 54. The frame further includes an upstanding hollow column 56 that supports the conveyor means 22, and a plurality of upstanding posts 58 that support the slide section 14. The upstanding column 56 is generally circular in cross-section and supports at is upper end the inclined support 60 of the conveyor means.

That support 60 includes a bottom wall 62, a pair of upright side walls 64, and at the upper end of each side wall an inturned lip 66. The bottom wall 62 has a depending channel portion 67 which receives the spiral screw 24. The cross-section of the conveyor support 60 is seen best in FIG. 4'. The lips 66 serve to retain the base or board portions 23 of the objects as the objects are moved upwardly along the incline of the conveyor means. The upper portions of the spiral rib 26 of the rotating screw 24 engage the angled grooves 28 formed in the underside of the object base 23 so that the rotation of the screw 24 causes this upward movement of the objects. The inclined support 60 also includes suitable bearing means (not shown) for rotatably supporting the screw 24 at its opposite ends. It will be noted that the support 60 is open at the lower and upper ends for respectively receiving and discharging the objects.

The illustrated objects 20 each include a generally rectangular board or base 23 on which a humanoid figure representation 21 is secured. The human figures may be shown in different positions to provide added interest and diversity to the child users. The objects may take various other forms such as animal figures, boats, submarines, boulders, tree branches, etc. etc.

As shown best in FIG. 2, the means for rotating the screw 24 the electric motor 40 in driving engagement with the gear train 44, which in turn meshes with the spiral screw 24 so that rotation of the motor shaft is transmitted to the screw. The gear train 44 serves to slow down the rpm of the motor shaft to a desirable rotating speed for the screw. The illustrated gear train 44 comprises a worm 69 which is fixed on the motor shaft and meshes with a worm gear 71. The worm gear 71 is coaxially fixed on a shaft with a bevel gear 73 that engages a large spur gear 75. The gear 75 extends through a suitable opening in the bottom wall channel portion 67 and meshes with a pair of gear segments 77 formed on the spiral rib 26 of screw 24. Adjacent to the reservoir there is a battery housing portion 68 which provides a space for one or more dry cell batteries 42 to be positioned in engagement with suitable electric contacts (not shown). The batteries are thereby connected through suitable circuitry (not shown) to the motor. The circuitry may include an on/off switch (not shown) accessible from the outside of the toy. It is generally contemplated that the motor will operate in a continuous manner to continuously rotate the screw, however other manners or modes of operation may be utilized if desired.

The slide section 14 includes the upper spiral portion which is connected to the lower extended curved portion. The slide section has a bottom wall 70 and upright side walls 72 for confining the objects and also the water which flows down the slide section. The slide section is supported in its downwardly spiraling position by the various upstanding frame support poles 58 noted above.

As described generally above movement of the objects 20 changes along a continuous smooth curve from a downwardly direction at the lower end 18 of the slide section to an upwardly inclined direction at the lower end of the conveyor means. This change in direction is facilitated by having the lower end 46 of the screw 24 curved and enlarged. By this means the fast moving object is caused to make a rapid change in direction in a generally smooth and continuous way so as not to bind or hang up at this juncture.

Returning to FIG. 6, the water delivery means comprises a pump 32 and the conduit 34. The pump is located within the reservoir 30 and communicates with the lower end of the conduit. The conduit extends upwardly to outwardly flared outlet 36 (FIG. 4A) located at the upper end of the slide section. The outlet 36 extends transversely essentially the width of the slide section. A extension 79 of the shaft of the motor 40 extends downwardly through column 56 and is operatively connected to the pump 32. (See FIGS. 2 and 6). The pump has curved impeller blades 74 which act to draw water from the reservoir and force it up through the conduit 34. As shown in FIG. 4, the water pumped up through the conduit 34 is discharged through the outlet 36 onto the upper end 16 of the slide section.

The ribs 48 located at the upper end of the slide section serve to maintain the objects, as the objects leave the upper end of to maintain the conveyor and passing onto the upper end of the slide section, spaced away from the water outlet 36 so as to ensure continuous and unobstructed flow from that outlet. The side walls 72 of the slide section upper end 16 are heightened at 73 to ensure that the objects are maintained upon the slide section while they go over the ribs 48.

FIGS. 3 and 6 show the passageway 38 from the lower end 18 of the slide section back into the reservoir 30 for the water coming down the slide section. Thus, the same limited quantity of water (for example one-half ($\frac{1}{2}$) a cup) can be continuously recirculated from the reservoir, up to the top of the slide section, down the slide section, and then back into the reservoir. The illustrated slide section is provided with sufficient incline to ensure that the objects reach the bottom of the slide section and that the water discharged onto the slide section returns to the reservoir.

As noted above the power for operating the water pump and the rotation of conveyor screw could be provided by a manual means such as a hand crank (not shown) if desired.

Various other modifications and changes could be made in the illustrated structure without departing from the spirit and scope of the present invention as set forth in the following claims. For example, the particular configuration of the slide section could be modified. By way of further example, the conveyor means for carrying the objects from the lower end of the slide back up to the upper end of the slide could be modified, although the illustrated conveyor screw mechanism is a particularly desirable and advantageous one for this particular toy.

The toy may be constructed of various suitable materials: various plastic materials would tend to be preferred as they are resistant to rust and corrosion from exposure to water, they are relatively inexpensive and light weight, and they tend to be impervious and do not absorb water or permit it to soak into or leak through the material.

What is claimed is:

1. A water slide toy comprising:

(a) a frame;

(b) a downwardly inclined slide section on the frame, the slide section having an upper end and a lower end;

(c) means on the frame for moving separate, discrete objects from the slide section lower end to the slide section upper end, so that the objects can slide from the slide section upper end downwardly along the slide section;

(d) means connected to the frame for holding a quantity of water and delivering water to the slide section upper end, to facilitate the downward sliding of the objects along the slide section; and (e) means between the slide section and the water holding means for returning water from the slide section to the holding means;

wherein the slide section comprises upright side walls to retain the water and the moving objects;

wherein the object moving means comprise a conveyor mechanism which engages and moves the objects upwardly therealong;

wherein the conveyor mechanism comprises an elongated rotating spiral screw which releasably engages matching means on the objects to move the objects therealong; and wherein the rotating screw has a spirally extending rib and said objects are provided on their undersides with a series of angled grooves arranged and proportioned to engage said spirally extending rib.

2. An electrically powered water slide toy especially for use by younger children and for use with a limited quantity of water such as, for example, less than a cup of water; said toy comprising:

(a) a frame;

(b) a downwardly inclined slide section on the frame, the slide section having an upper end and a lower end;

(c) means on the frame for moving separate, discrete objects from the slide section lower end to the slide section upper end, so that the objects can slide from the slide section upper end downwardly along the slide section;

(d) means connected to the frame for holding a quantity of water and delivering water to the slide section upper end, to facilitate the downward sliding of the objects along the slide section; the water delivering means comprising an electrically powered water pump and a conduit which is in communication with the pump and which has an outlet, the pump being located at about the level of the slide section lower end and the conduit outlet being located at approximately the level of the slide section upper end; and (e) means between the slide section and the water holding means for returning water from the slide section to the holding means;

wherein the slide section comprises upright side walls to retain the water and the moving objects; and wherein the water holding means comprise as essentially closed reservoir located at about the level of the slide section lower end, the pump being disposed within the reservoir;

whereby such younger children can use the water slide toy with such limited quantity of water and corresponding minimal possibility of water spillage, and with minimal possibility of electrical hazard to such younger children.

3. A water slide toy as set forth in claim 2 wherein said slide section includes a curved portion that cooperates with said moving means to provide a complete loop for said objects.

4. A water slide toy as set forth in claim 3 wherein said slide section includes a downwardly spiraled portion.

5. A water slide toy as set forth in claim 2 wherein said object moving means comprises a conveyor mechanism which engages and moves the objects upwardly therealong.

6. A water slide toy as set forth in claim 5 wherein said conveyor mechanism comprises an elongated rotating spiral screw which releaseably engages matching means on said objects to move said objects therealong.

7. A water slide toy as set forth in claim 2 wherein said water delivering means includes motor means operatively connected to said water pump to selectively drive said water pump.

8. A water slide toy as set forth in claim 7 wherein said water delivering means further comprises means for supporting a dry cell battery and a circuit means operatively connected between said battery holding means and said motor means, said circuit means including an on/off switch operable by the user from externally of said toy.

9. A water slide toy comprising:

(a) a frame;

(b) a downwardly inclined slide section on the frame, the slide section having an upper end and a lower end;

(c) means on the frame for moving separate, discrete objects from the slide section lower end to the slide section upper end, so that the objects can slide from the slide section upper end downwardly along the slide section;

(d) means connected to the frame for holding a quantity of water and delivering water to the slide section upper end, to facilitate the downward sliding of delivering means comprising a water pump and a conduit which is in communication with the pump and which has an outlet, the pump being located at about the level of the slide section lower end and the conduit outlet being located at approximately the level of the slide section upper end; and (e) means between the slide section and the water holding means for returning water from the slide section to the holding means;

wherein the slide section comprises upright side walls to retain the water and the moving objects; and wherein the conduit outlet is located so as to discharge onto the upper end of the slide section;

the slide section upper end further including projections adapted and arranged to receive and support objects moving onto the slide section upper end and maintain the objects spaced away from the conduit outlet to prevent interference with the flow of water from the outlet.

10. A water slide toy as set forth in claim 9 wherein said projections comprise a pair of laterally spaced apart upright ribs having generally curved upright edges generally conforming to the direction of flow downwardly along said slide section upper end.

11. The water slide toy as set forth in claim 10 wherein said side walls are relatively heightened adjacent to said ribs to ensure retention of the objects on the slide section.

12. A water slide toy comprising:

(a) a frame;

(b) a downwardly inclined slide section on the frame, the slide section having an upper end and a lower end;

(c) means on the frame for moving separate, discrete objects from the slide section lower end to the slide section upper end, so that the objects can slide from the slide section upper end downwardly along the slide section;

(d) means connected to the frame for holding a quantity of water and delivering water to the slide section upper end, to facilitate the downward sliding of the objects along the slide section; and (e) means between the slide section and the water holding means for returning water from the slide section to the holding means;

wherein the slide section comprises upright side walls to retain the water and the moving objects;

wherein the object moving means comprise a conveyor mechanism which engages and moves the objects upwardly therealong;

wherein the conveyor mechanism comprises an elongated rotating spiral screw which releaseably engages matching means on the objects to move the objects therealong; and wherein the lower end portion of the spiral screw is enlarged to provide a gradual change in direction of movement of an object received at the lower end of said screw.

13. A water slide toy comprising:

(a) a frame;

(b) a downwardly inclined slide section on the frame, the slide section having an upper end and a lower end;

(c) means on the frame for moving separate, discrete objects from the slide section lower end to the slide section upper end, so that the objects can slide from the slide section upper end downwardly along the slide section;

(d) means connected to the frame for holding a quantity of water and delivering water to the slide section upper end, to facilitate the downward sliding of the objects along the slide section;

(e) means between the slide section and the water holding means for returning water from the slide section to the holding means; and (f) a plurality of separate, discrete objects sized and otherwise adapted for motion down the slide section and upward along the moving means; and at least some of the objects having a center of gravity and weight distribution which tend to retain them on the slide section during downward motion, but which tend to cause them to fall rearwardly from the moving means;

wherein the slide section comprises upright side walls to retain the water and the moving objects;

wherein the object moving means comprise a conveyor mechanism which engages and moves the objects upwardly therealong;

wherein the objects are too large to fit between successive threads of the spiral screw; and wherein the conveyor mechanism comprises an elongated rotating spiral screw, having threads, which releasably engages matching means on the objects to move the objects therealong;

wherein the moving means include guide means extending therealong which engage the objects and retain them in operating contact with the spiral screw as the objects move upwardly along the moving means.

14. A water slide toy as set forth in claim 13, wherein:

said water delivering means comprises a water pump and a conduit which is in communication with said pump and which has an outlet, said pump being located at about the level of said slide section lower end and said conduit outlet being located at approximately the level of said slide section upper end.

15. A water slide toy as set forth in claim 13, wherein:

the guide means comprise inwardly projecting overhanging lips which engage marginal side portions of the objects to prevent the objects from falling rearwardly from the moving means.

16. A water slide toy as set forth in claim 13, wherein said moving means includes drive means for imparting rotation to said spiral screw.

17. A water slide toy as set forth in claim 16 wherein said drive means comprises a motor and a speed reducing gear train operatively connected between the motor and the spiral screw.

18. A water slide toy as set forth in claim 17 wherein said water delivering means includes a pump operatively connected to a conduit leading to and having an outlet at the upper end of said slide section, said motor being operatively connected in driving relation to said pump.

* * * * *